United States Patent [19]

Graf

[11] 3,949,789

[45] Apr. 13, 1976

[54] HEDDLE FRAME STAVE WITH CLOSED T-RAIL

[75] Inventor: Martin Graf, Horgen, Switzerland

[73] Assignee: Grob & Co. Aktiengesellschaft, Horgen, Switzerland

[22] Filed: Mar. 6, 1975

[21] Appl. No.: 556,034

Related U.S. Application Data

[63] Continuation of Ser. No. 369,386, June 12, 1973, abandoned.

[30] Foreign Application Priority Data

June 14, 1972 Switzerland ..... 8831/72

[52] U.S. Cl. ..... 139/91

[51] Int. Cl.[2] ..... D03C 9/06

[58] Field of Search ..... 139/91, 92, 88, 82, 84

[56] References Cited

UNITED STATES PATENTS

| | | | |
|---|---|---|---|
| 1,866,908 | 7/1932 | Robertson | 139/92 |
| 2,708,455 | 5/1955 | Kaufmann | 139/92 |
| 2,944,571 | 7/1960 | Pfarrwaller | 139/91 |
| 3,417,790 | 12/1968 | Pfarrwaller | 139/91 |

FOREIGN PATENTS OR APPLICATIONS

| | | | |
|---|---|---|---|
| 498,883 | 5/1930 | Germany | 139/84 |
| 846,983 | 6/1939 | France | 139/92 |
| 274,498 | 6/1951 | Switzerland | 139/91 |
| 404,582 | 7/1966 | Switzerland | 139/88 |
| 430,615 | 8/1967 | Switzerland | 139/91 |

*Primary Examiner*—James Kee Chi

*Attorney, Agent, or Firm*—Sughrue, Rothwell, Mion, Zinn & Macpeak

[57] ABSTRACT

A frame stave for the head frame of a weaving machine is extruded with a closed, internal T shaped channel 10 in its upper edge. When the location of connecting hooks 5 is determined, a portion of the top edge of the stave is machined away at 6 to enable the hooks to be attached to the stave by screws 8 and sliding inserts 9 within the channel.

2 Claims, 4 Drawing Figures

HEDDLE FRAME STAVE WITH CLOSED T-RAIL

This is a continuation of application Ser. No. 369,386, filed June 12, 1973, now abandoned.

BACKGROUND OF THE INVENTION

1. Field of the Invention.

Heald frames of weaving machines mainly consist of an upper and a lower frame stave which, at their ends, are connected by lateral supports. In most cases the heald frames are suspended by connections to the frame staves in order to be driven in the weaving machine for the formation of the weaving shed. The connecting elements between the heald frame drive and the frame staves are usually movable in the latter in the longitudinal direction of the heald frame. For this purpose the frame stave is provided on the outer longitudinal edge with a profiled rail, generally in the form of an outer-T or an inner-T. On these T-rails the connecting elements to the frame drive are movably placed. This mobility is essential because the driving attachment of the weaving machine onto the heald frame cannot always be determined in advance.

2. Description of the Prior Art

The T-rails used up to now on the frame staves show substantial disadvantages. The outer T-rails have a relatively thin fillet which often breaks at the place where it changes its shape to the body of the frame stave. On the other hand, the inner T-rail has proved to be more robust. The disadvantage, however, is that the inner T-rail at the upper frame stave gets filled up with dust and dirt. If enough fluff is accumulated in this T-rail, bundles of such dirt will fall in the warp and will consequently be woven into the fabric, leading to poor quality fabrics. This disadvantage can only be overcome by extensive cleaning of the upper edge of the heald frame. All experiments to work with covers and similar devices failed and for many years a considerable need for an improvement existed.

SUMMARY OF THE INVENTION

This invention eliminates the above-mentioned disadvantages without waiving the advantages in that the T-rails which run over the entire length of the frame stave are only open on the mounting place of the connecting elements, whereas the remaining length of the frame stave is closed.

In practice, the frame staves are manufactured of a light metal alloy in the well-known manner by means of extruding a metal tube such that the frame staves on their outer edges have closed T-rails over their entire length. Later on, when it is known where the connecting elements have to be fitted, the material on those places is machined away and the T-rail is opened and facing to the outside.

The invention produces a very simple but effective solution to the mentioned problem. The outer edge of the frame stave consists of a closed inner-T which is only opened at the mounting places. Therefore, the outer frame stave edge is closed almost over the entire length and presents a smooth surface which prevents dirt and fluff from being stuck to it.

DESCRIPTION OF THE PREFERRED EMBODIMENT

Figure 1:
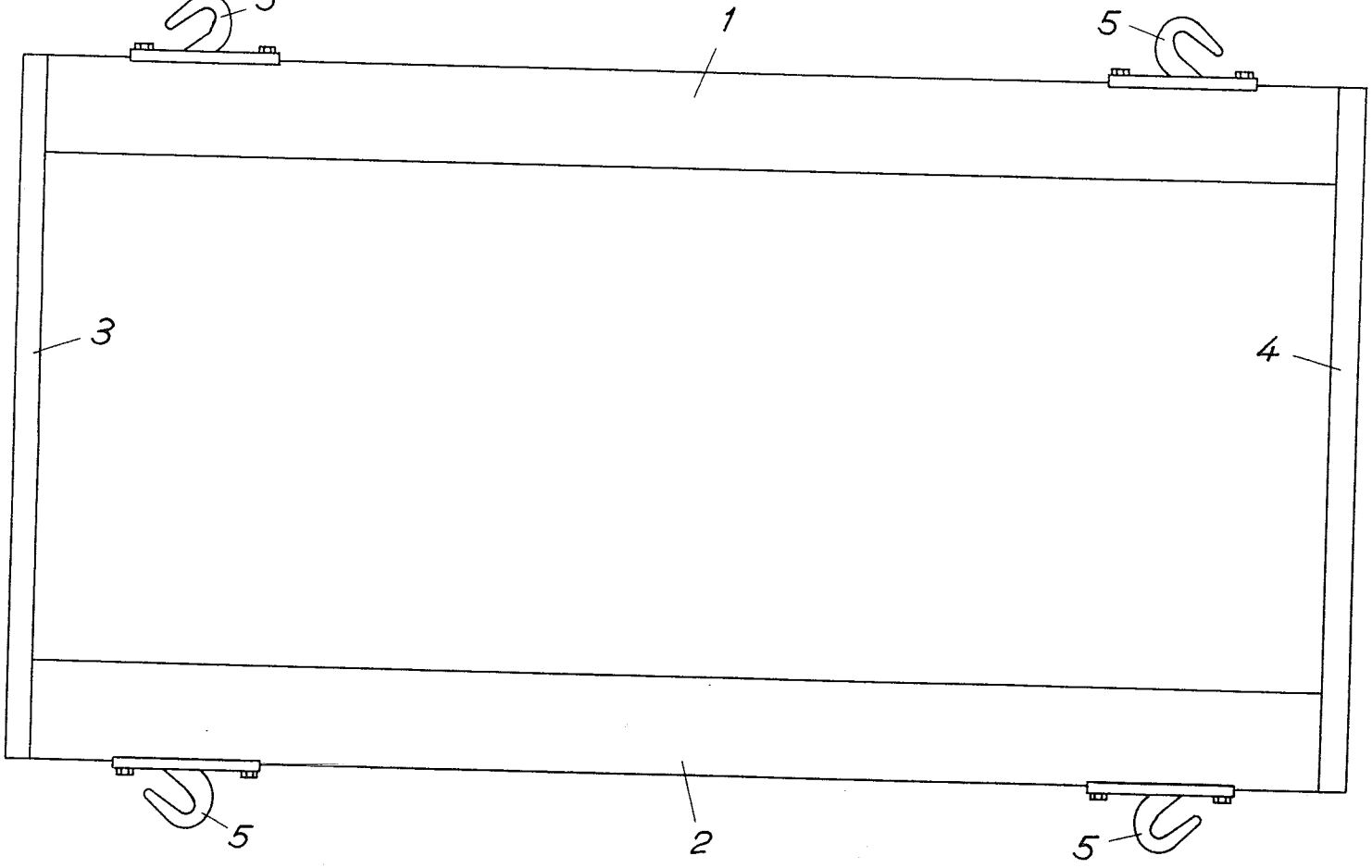
FIG. 1 shows a front view of a heald frame.

In the drawings, 1 is the upper frame stave and 2 is the lower frame stave. Both frame staves are made of a well-known light metal alloy. The frame staves 1 and 2 are connected by lateral supports 3 and 4. Hook members 5 are mounted on both of the frame staves and are connected with the frame drive in the known manner.

Figure 2:
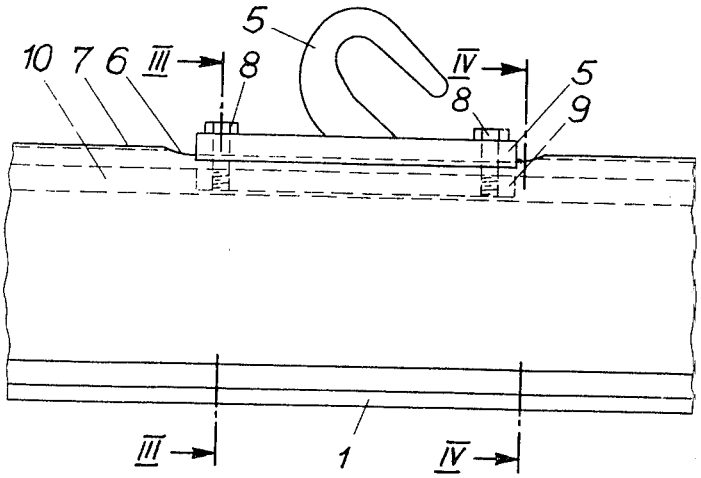
FIG. 2 shows a portion of FIG. 1 on an enlarged scale.
Figure 3:
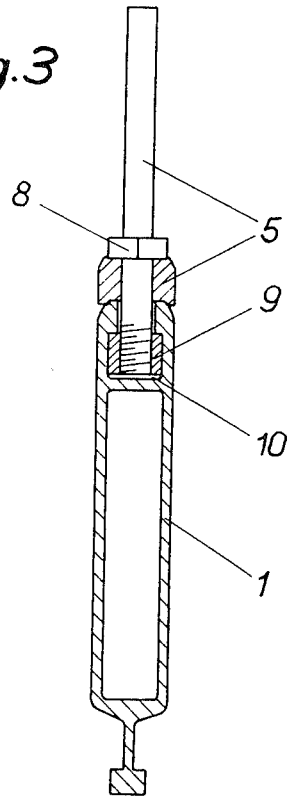
FIG. 3 shows a cross section through lines III — III in FIG. 2 on an enlarged scale.

From FIGS. 2 and 3 it can be seen that on the upper frame stave edge 7 a recess 6 is provided. This recess 6 can be made at any place on the frame stave edge 7 by machining or the like. The hook member 5 is attached by means of screws 8 and a sliding block 9 accomodated in a channel 10 in the T-rail.

Figure 4:
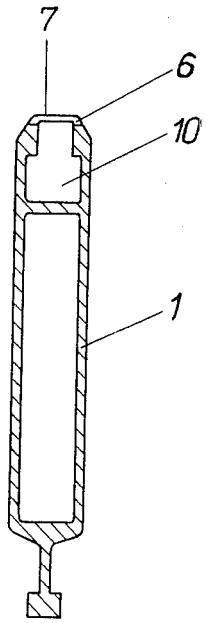
FIG. 4 shows a cross section through lines IV — IV in FIG. 2, also on an enlarged scale.

As shown in FIG. 4 the upper frame stave edge 7 is recessed at 6 so that the channel 10 presents an open face to accomodate the base of the hook member 5.

The recess 6 may be elongated in the direction of the heald frame so that, within limits, the hook member 5 together with the sliding block 9 may be longitudinally moved after loosening the screws 8.

What is claimed is:

1. A frame stave for the heald frame of a weaving machine comprising an extruded, light metal alloy rail having a channel intregrally formed along one edge thereof, said channel having a "T" shaped cross-section closed substantially along the entire length of the channel and oriented such that the cross member of the "T" is closest to the longitudinal axis of the rail, the wall thickness of the uppermost portion of the "T" channel being less than the side walls defining the channel, at least one recess in the uppermost edge extending down into the "T" shaped channel, and a frame drive connecting element located within the recess and attached to the frame stave.

2. A frame stave as defined in claim 1 wherein the connecting element is mounted by an insert slidable within the cross fillet of the channel.

* * * * *